US007258601B2

(12) United States Patent
Sato

(10) Patent No.: US 7,258,601 B2
(45) Date of Patent: Aug. 21, 2007

(54) MACHINING APPARATUS

(75) Inventor: Seishi Sato, Tokyo (JP)

(73) Assignee: Dicso Corporation, Tokyo (JP)

( * ) Notice: Subject to any disclaimer, the term of this patent is extended or adjusted under 35 U.S.C. 154(b) by 14 days.

(21) Appl. No.: 11/345,367

(22) Filed: Feb. 2, 2006

(65) Prior Publication Data

US 2006/0178098 A1 Aug. 10, 2006

(30) Foreign Application Priority Data

Feb. 4, 2005 (JP) ..... 2005-028893

(51) Int. Cl.
*B24B 45/00* (2006.01)

(52) U.S. Cl. ..... 451/178; 125/15; 451/360

(58) Field of Classification Search ..... 451/178, 451/360, 508, 541; 125/15, 13.01, 23.01
See application file for complete search history.

(56) References Cited

U.S. PATENT DOCUMENTS 3,886,925 A * 6/1975 Regan ..... 125/15
4,180,048 A * 12/1979 Regan ..... 125/15
5,778,751 A * 7/1998 Tsuchishima et al. ..... 83/666
6,341,600 B1 * 1/2002 Wakita ..... 125/13.01

FOREIGN PATENT DOCUMENTS

JP 2002-219648 8/2002
JP 2003-165036 6/2003

* cited by examiner

*Primary Examiner*—Robert A. Rose
(74) *Attorney, Agent, or Firm*—Smith, Gambrell & Russell, LLP

(57) ABSTRACT

A machining apparatus, comprising: a mounting member to be rotationally driven; a tool support member mounted on the mounting member; and a fixing member, fixed to the mounting member, for fixing the tool support member to the mounting member. The mounting member has a mounting outer peripheral surface of a generally cylindrical shape, a cylindrical mounting hole as a through-hole is formed in the tool support member, and the tool support member is mounted on the mounting member by fitting the mounting hole of the tool support member onto the mounting outer peripheral surface of the mounting member. The mounting outer peripheral surface of the mounting member has a guide region, a support region, and a relief region arranged sequentially in a central axial direction, the support region is of a cylindrical shape having an outer diameter D1, the outer diameter D2 of the guide region increases up to D1 toward the support region, and the outer diameter D3 of the relief region progressively decreases from D1 with increasing distance from the support region. The mounting hole of the tool support member has an inner diameter D4, and D4 is larger than D1 (D4>D1). The length in the central axial direction of the support region of the mounting outer peripheral surface is W1, and W1 is $\sqrt{D4^2-D1^2}$ or smaller ($W1 \leqq \sqrt{D4^2-D1^2}$).

8 Claims, 7 Drawing Sheets

MACHINING APPARATUS

FIELD OF THE INVENTION

This invention relates to a machining apparatus, such as a cutting apparatus, provided with a thin-walled annular cutting blade as a machining tool. More specifically, the invention relates to a machining apparatus comprising a mounting member to be rotationally driven, a tool support member mounted on the mounting member, and a fixing member, fixed to the mounting member, for fixing the tool support member to the mounting member.

DESCRIPTION OF THE PRIOR ART

As a typical example of a precision machining apparatus equipped with a machining tool to be rotationally driven, a cutting apparatus, called a dicer, applied to the cutting of a semiconductor wafer can be named. Such a cutting apparatus has a rotating shaft mounted rotatably, and a mounting member detachably fixed to the rotating shaft, as disclosed in Japanese Patent Application Laid-Open No. 2002-219648 and Japanese Patent Application Laid-Open No. 2003-165036. A tool support member is mounted on the mounting member, and a fixing member for fixing the tool support member to the mounting member is fixed to the mounting member. In further detail, the mounting member has a mounting outer peripheral surface of a cylindrical shape, and a cylindrical mounting hole as a through-hole is formed in the tool support member. The tool support member is mounted on the mounting member by fitting the mounting hole as a through-hole onto the mounting outer peripheral surface. A through-hole having an internal thread formed thereon is formed in the fixing member, while an external thread located forwardly of the mounting outer peripheral surface is formed in the mounting member. By screwing the internal thread onto the external thread, the fixing member is fixed to the mounting member. An annular flange surface located rearwardly of the mounting outer peripheral surface is formed in the mounting member. When the fixing member is fixed to the mounting member, the tool support member is sandwiched between the annular flange surface of the mounting member and the rear surface of the fixing member, whereby the tool support member can be firmly fixed to the mounting member. A thin-walled annular cutting blade is fixed to the tool support member, or is sandwiched between the tool support member and the mounting member.

In the above-described cutting apparatus, the avoidance, if possible, of the eccentricity of the cutting blade with respect to the rotating shaft, accordingly, the eccentricity of the tool support member with respect to the mounting member, is important for precision cutting. For this purpose, the difference between the outer diameter (D1) of the mounting outer peripheral surface of the mounting member and the inner diameter (D4) of the mounting hole of the tool support member, namely, the difference (D4−D1), is set at a sufficiently small value of the order of 5 to 20 μm.

According to the inventor's experience, the above-mentioned conventional cutting apparatus has the following problems: In fitting the mounting hole of the tool support member onto the mounting outer peripheral surface of the mounting member, it is practically impossible to move the tool support member relative to the mounting member in a central axial direction, with the central axis of the mounting outer peripheral surface and the central axis of the mounting hole in complete agreement. The reality is that the tool support member is moved relative to the mounting member, with the central axis of the mounting hole being somewhat inclined with respect to the central axis of the mounting outer peripheral surface. As a result, the edge of the mounting hole tends to be pressed against the mounting outer peripheral surface during the movement of the tool support member, causing so-called drag. If the drag occurs, smooth fitting of the mounting hole onto the mounting outer peripheral surface is impeded, and damage is caused to the mounting outer peripheral surface and/or the edge of the mounting hole.

SUMMARY OF THE INVENTION

A principal object of the present invention is, therefore, to improve a machining apparatus, such as the cutting apparatus having the thin-walled annular cutting blade as the cutting tool, such that the occurrence of drag is avoided when the mounting hole of the tool support member is fitted onto the mounting outer peripheral surface of the mounting member.

The inventor diligently conducted studies, and has found that the above principal object can be attained by imparting a unique shape to the mounting outer peripheral surface of the mounting member.

According to the present invention, there is provided, as a machining apparatus for attaining the above principal object, a machining apparatus comprising a mounting member to be rotationally driven, a tool support member mounted on the mounting member, and a fixing member, fixed to the mounting member, for fixing the tool support member to the mounting member, the mounting member having a mounting outer peripheral surface of a generally cylindrical shape, and a cylindrical mounting hole as a through-hole being formed in the tool support member, and the tool support member being mounted on the mounting member by fitting the mounting hole of the tool support member onto the mounting outer peripheral surface of the mounting member, and wherein the mounting outer peripheral surface of the mounting member has a guide region, a support region, and a relief region arranged sequentially in a central axial direction, the support region is of a cylindrical shape having an outer diameter D1, an outer diameter D2 of the guide region increases up to D1 toward the support region, an outer diameter D3 of the relief region decreases from D1 with increasing distance from the support region, the mounting hole of the tool support member has an inner diameter D4, D4 is larger than D1 (D4>D1), the length in the central axial direction of the support region of the mounting outer peripheral surface is W1, and W1 is $\sqrt{D4^2-D1^2}$ or smaller ($W1 \leqq \sqrt{D4^2-D1^2}$).

Preferably, D4−D1 is 5 to 20 μm (5 μm≦D4−D1≦20 μm), particularly 5 to 10 μm (5 μm≦D4−D1≦10 μm). Preferably, the length in the central axial direction of the mounting hole is W2, and W2 is W1 or larger (W2≧W1). Preferably, the sectional shape in the central axial direction of the guide region of the mounting outer peripheral surface is an arc, and the radius of curvature of the arc is D1/2 or smaller. Advantageously, the mounting member is detachably fixed to a rotating shaft mounted rotatably, and a thin-walled annular cutting blade is fixed to the tool support member, or the thin-walled annular cutting blade is sandwiched between the mounting member and the tool support member.

DETAILED DESCRIPTION OF THE PREFERRED EMBODIMENTS

The preferred embodiments of a machining apparatus constructed in accordance with the present invention will now be described in detail with reference to the accompanying drawings.

Figure 1:
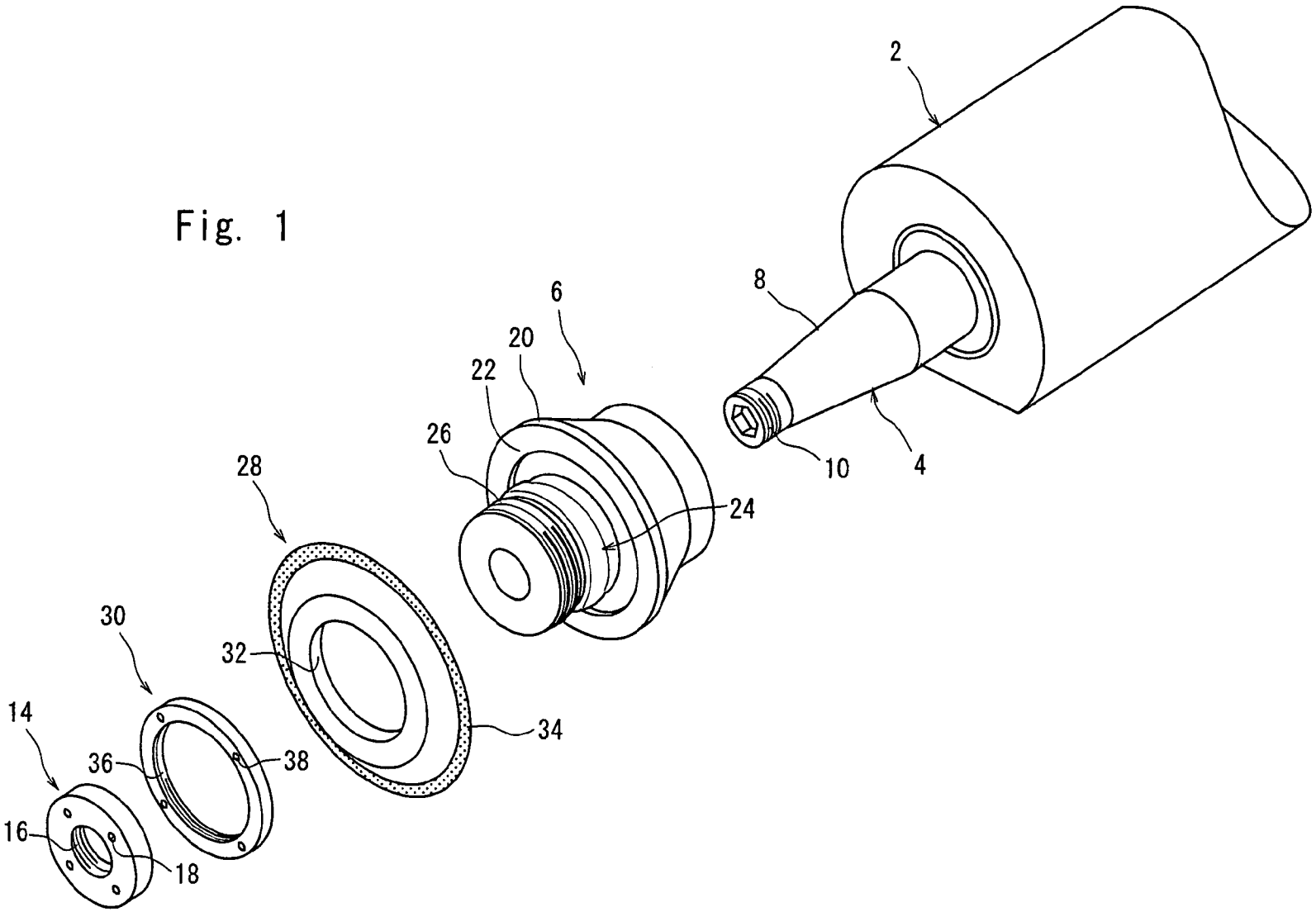
FIG. 1 is an exploded perspective view showing constituent elements concerned with mounting of a cutting blade in a preferred embodiment of a machining apparatus constructed in accordance with the present invention.
Figure 2:
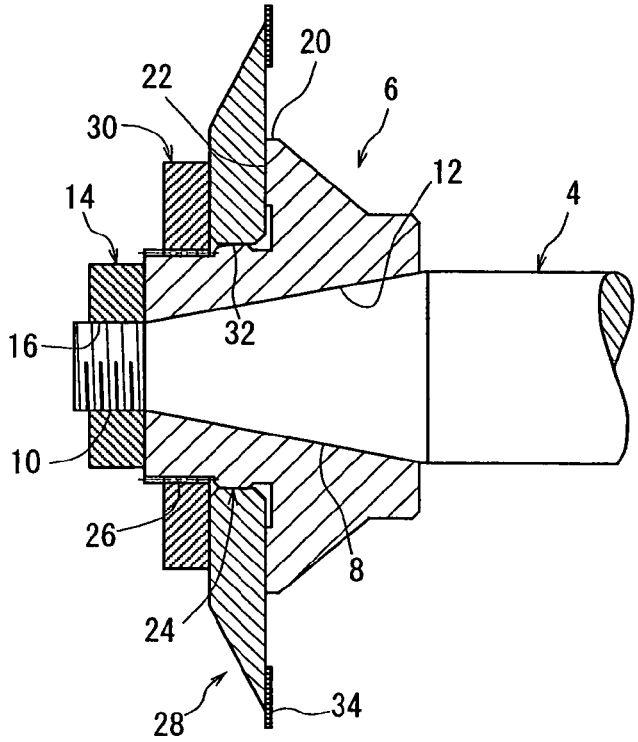
FIG. 2 is an assembly sectional view of the constituent elements shown in FIG. 1.

FIGS. 1 and 2 show some of the constituent elements of a cutting apparatus as a preferred embodiment of the machining apparatus constructed in accordance with the present invention, namely, the constituent elements concerned with the mounting of a thin-walled annular cutting blade. The entire configuration of the cutting apparatus is disclosed in the aforementioned Japanese Patent Application Laid-Open No. 2002-219648 and Japanese Patent Application Laid-Open No. 2003-165036. Such disclosures are incorporated herein by reference to omit relevant descriptions.

With reference to FIGS. 1 and 2, the illustrated cutting apparatus is provided with a casing 2, and a rotating shaft 4 is rotatably mounted on the casing 2. A front end portion of the rotating shaft 4 extends forward beyond the front surface of the casing 2. A rotational drive source (not shown), which may be an electric motor, is disposed within the casing 2, and when this rotational drive source is energized, the rotating shaft 4 is rotated at a high speed. A mounting member 6 is mounted on the front end portion of the rotating shaft 4. In detail, a taper portion 8 of a truncated conical shape having an outer diameter progressively decreasing toward the front end is formed in the front end portion of the rotating shaft 4. An external thread 10 is formed on the outer peripheral surface of a cylindrical portion of a relatively small diameter located nearer to the front end than the taper portion 8. As shown clearly in FIG. 2, a taper hole 12 of a truncated conical shape having an inner diameter progressively decreasing frontward (leftward in FIG. 2) is formed at the center of the mounting member 6. The taper angle of the taper portion 8 of the rotating shaft 4 and the taper angle of the taper hole 12 of the mounting member 6 are substantially the same. The taper hole 12 of the mounting member 6 is fitted over the taper portion 8 of the rotating shaft 4 to mount the mounting member 6 on the rotating shaft 4. Then, a nut member 14 as a fixing means is screwed to the external thread 10 of the rotating shaft 4 to urge the mounting member 6 rearward (rightward in FIG. 2), whereby the mounting member 6 is firmly fixed to the rotating shaft 4, with the taper hole 12 of the mounting member 6 in sufficiently intimate contact with the taper portion 8 of the rotating shaft 4. The ring-shaped nut member 14 has an internally threaded through-hole 16 formed at its center, and has four small blind holes 18 formed at intervals in the circumferential direction. In screwing the nut member 14 onto the rotating shaft 4, tightening means (not shown) can be engaged with the small blind holes 18. If desired, it is possible to form the rotating shaft 4 and the mounting member 6 integrally, instead of detachably fixing the mounting member 6, which has been separately formed, to the rotating shaft 4.

With reference to FIGS. 1 and 2, an annular protrusion 20 protruding in the radial direction is formed in a rear portion (a right portion in FIG. 2) of the mounting member 6. A peripheral edge portion of the front surface (left surface in FIG. 2) of the annular protrusion 20 is protruded somewhat forwardly, and the front surface of the peripheral edge portion defines an annular contact surface 22 substantially perpendicular to the central axis of the mounting member 6. A mounting outer peripheral surface 24 of a generally cylindrical shape is formed in a front portion (left portion in FIG. 2) of the mounting member 6. The mounting outer peripheral surface 24 will be further described later in detail. An external thread 26 is formed on a cylindrical outer peripheral surface of the mounting member 6 which is located forwardly of the mounting outer peripheral surface 24.

Figure 3:
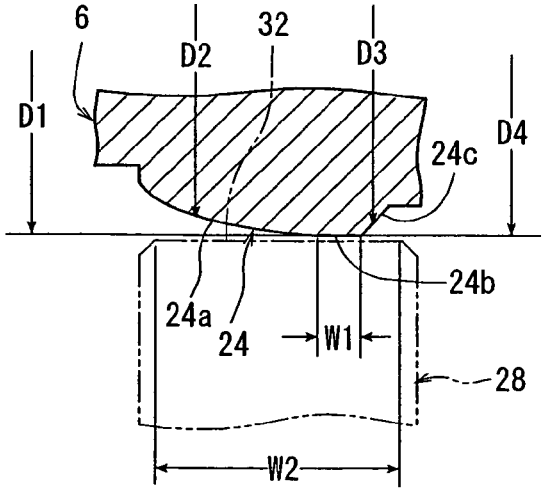
FIG. 3 is an enlarged sectional view showing, in an enlarged manner, some of the constituent elements shown in FIG. 1.

A tool support member 28 is mounted on the mounting member 6, and a fixing member 30 for firmly fixing the tool support member 28 to the mounting member 6 is mounted on the mounting member 6. The tool support member 28 in the illustrated embodiment is ring-shaped as a whole, and has a mounting hole 32 formed as a through-hole at the center thereof. With reference to FIG. 3 along with FIGS. 1 and 2, a main portion of the mounting hole 32 is of a cylindrical shape having an inner diameter D4 and a length W2 in the central axial direction. The front end and the rear end of the mounting hole 32 are beveled. The rear surface of the tool support member 28 is substantially perpendicular to the central axis of the tool support member 28, and a thin-walled annular cutting blade 34 is secured to an outer peripheral edge portion of the rear surface. An outer peripheral edge portion of the cutting blade 34 protrudes radially outwardly beyond the outer peripheral edge of the tool support member 28. Such a cutting blade 34 is advantageously formed integrally at a required site of the tool support member 28 by electroforming well known among people skilled in the art (namely, a method in which diamond grains are dispersed in a suitable metal, such as nickel, to be electroplated on a required surface of the tool support member 28). The fixing member 30 is composed of a ring-shaped nut member, which has an internally threaded through-hole 36 formed at its center, and has four small blind holes 38 formed at intervals in the circumferential direction.

As shown in FIG. 2, the tool support member 28 is mounted on the mounting member 6 by having its mounting hole 32 fitted over the mounting outer peripheral surface 24 of the mounting member 6. Then, the internally threaded hole 36 of the fixing member 30 is screwed onto the external thread 26 of the mounting member 6, whereby the fixing member 30 is mounted on the mounting member 6. As a result, the tool support member 28 is sandwiched between the annular contact surface 22 of the mounting member 6 and the fixing member 30, so that the tool support member 28 is firmly fixed to the mounting member 6. In screwing the internally threaded hole 36 of the fixing member 30 onto the external thread 26 of the mounting member 6, tightening means (not shown) can be engaged with the small blind holes 38.

With reference to FIG. 3 along with FIGS. 1 and 2, it is important for the mounting outer peripheral surface 24 disposed on the mounting member 6 to have a guide region 24*a*, a support region 24*b*, and a relief region 24*c* arranged in this sequence. The support region 24*b* is of a cylindrical shape, and has an outer diameter D1 and a length W1 in the central axial direction. The outer diameter D2 of the guide region 24*a* is progressively increased up to D1 toward the support region 24*b*. In the illustrated embodiment, it is advantageous that the outer peripheral surface of the guide region 24*a*, in a sectional view taken in the central axial direction, is an arc having a center on a straight line extending substantially perpendicularly to the central axis at the boundary between the guide region 24*a* and the support region 24*b*, and the radius of curvature of the arc is D1/2 or smaller. The outer diameter D3 of the relief region 24*c* is progressively decreased with increasing distance from the support region 24*b*. The outer peripheral surface of the relief region 24*c* may be, for example, truncated conical.

Figure 4:
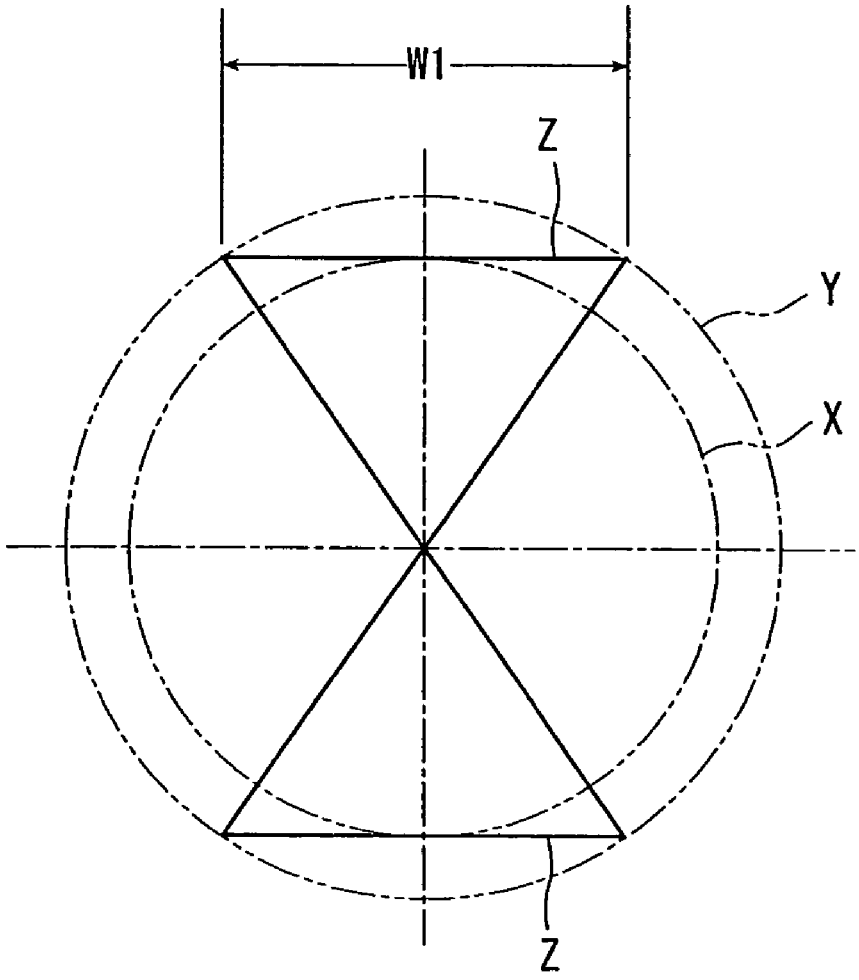
FIG. 4 is a schematic view for illustrating the principle of avoiding the occurrence of drag between a mounting outer peripheral surface and a mounting hole in the constituent elements shown in FIG. 1.

It is important that the above outer diameter D1 of the support region 24*b* in the mounting outer peripheral surface 24 of the mounting member 6 is set to be slightly smaller than the inner diameter of D4 of the mounting hole 32 of the tool support member 28. Preferably, D4−D1 is 5 to 20 μm (5 μm≦D4−D1≦20 μm), particularly 5 to 10 μm (5 μm≦D4−D1≦10 μm). It is important that the length W1 in the central axial direction of the support region 24*b* is $\sqrt{D4^2-D1^2}$ or smaller ($W1 \leqq \sqrt{D4^2-D^2}$). This feature will be described with reference to FIG. 4. The diameter of a circle X indicated by a long dashed double-short dashed line in FIG. 4 is the same as the diameter D1 of the support region 24*b* of the mounting outer peripheral surface 24, while the diameter of a circle Y indicated by a long dashed double-short dashed line in FIG. 4 is the same as the inner diameter D4 of the mounting hole 32. Two straight lines Z are tangents to the circle X at two points opposed to each other in the diametrical direction. In FIG. 4, the length of the straight line Z between two points at which the straight line Z intersects the circle Y is $\sqrt{D4^2-D1^2}$. From FIG. 4, it is understood that if the length W1 of the straight line Z (namely, the length W1 in the central axial direction of the support region 24*b* of the mounting outer peripheral surface 24) is $\sqrt{D4^2-D1^2}$ or smaller, the straight line Z does not interfere with the circle Y, even if the straight line Z tilts in an arbitrary direction, with the center of the circle X as the center of tilting (namely, even if the support region 24*b* tilts in an arbitrary direction relative to the tool support member 28). Thus, it is understood that even if the mounting hole 32 tilts in an arbitrary direction relative to the mounting outer peripheral surface 24, the inner peripheral surface of the mounting hole 32 does not cause drag to the mounting outer peripheral surface 24. In other words, if the length W1 in the central axial direction of the support region 24*b* of the mounting outer peripheral surface 24 is $\sqrt{D4^2-D1^2}$ or smaller, drag of the edge of the mounting hole 32 of the tool support member 28 over the support region 24*b* of the mounting outer peripheral surface 24 is reliably avoided, even if the tool support member 28 is inclined when the mounting hole 32 of the tool support member 28 is fitted over the mounting outer peripheral surface 24 of the mounting member 6. If the length of the straight line Z (namely, the length W1 in the central axial direction of the support region 24*b* of the mounting outer peripheral surface 24) exceeds $\sqrt{D4^2-D1^2}$, the straight line Z interferes with the circle Y (that is, if the tool support member 28 tilts with respect to the support region 24*b*, the straight line Z interferes with the circle Y). Hence, drag is likely to occur between the support region 24*b* of the mounting outer peripheral surface 24 and the mounting hole 32.

To support the tool support member 28 stably and render the strength of the support region 24*b* of the mounting outer peripheral surface 24 as high as possible, the length W1 in the central axial direction of the support region 24*b* is desired to be as large as possible. Thus, the length W1 in the central axial direction of the support region 24*b* is set, particularly advantageously, at $\sqrt{D4^2-D1^2}$ or a value slightly smaller than it. The length W2 in the central axial direction of the mounting hole 32 is preferably not smaller than the length W1 in the central axial direction of the support region 24*b* (W2≧W1).

Figure 5:
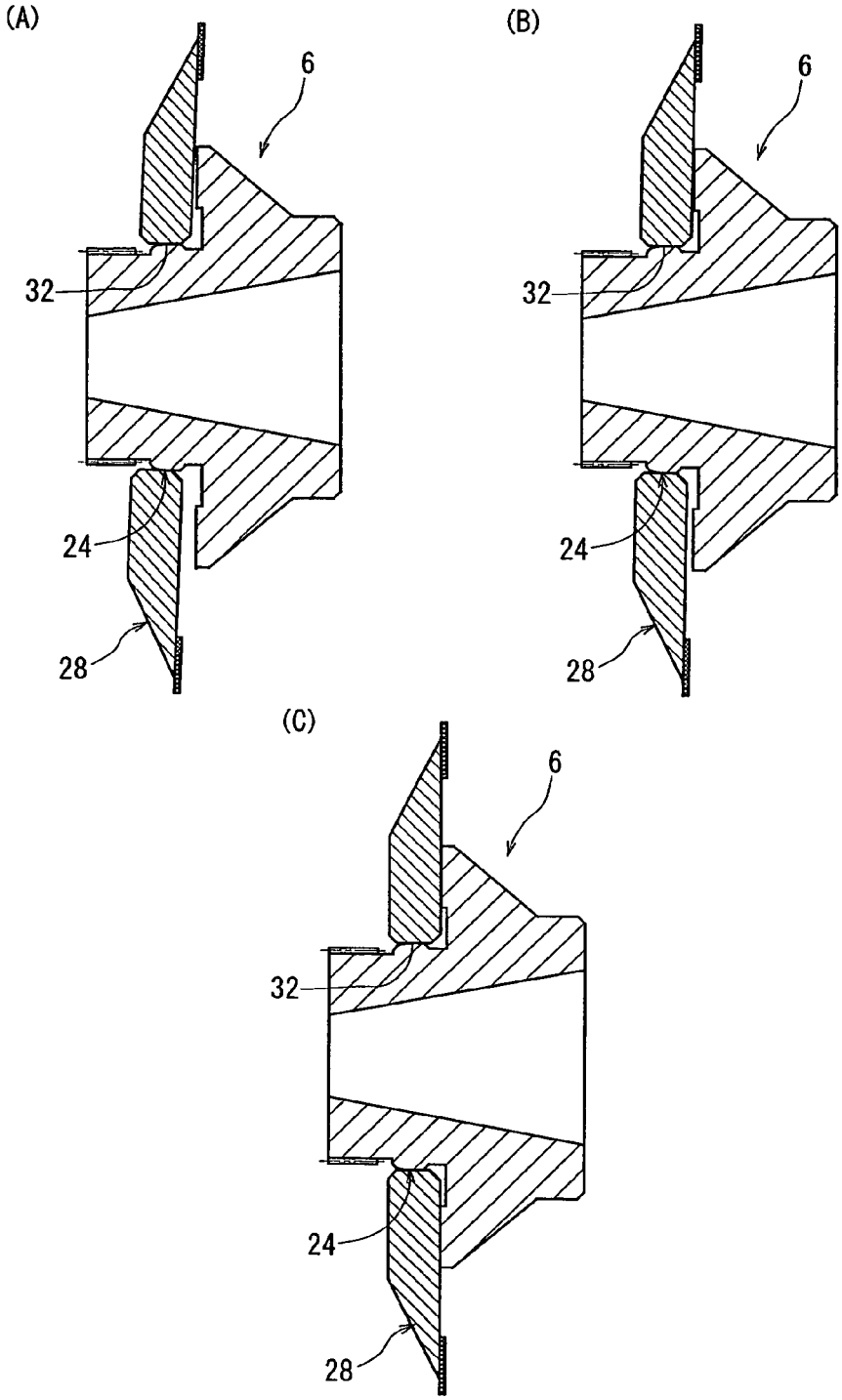
FIGS. 5(A) to 5(C) are sectional views showing the behaviors of a tool support member when the tool support member is mounted on a mounting member in the constituent elements shown in FIG. 1.
Figure 6:
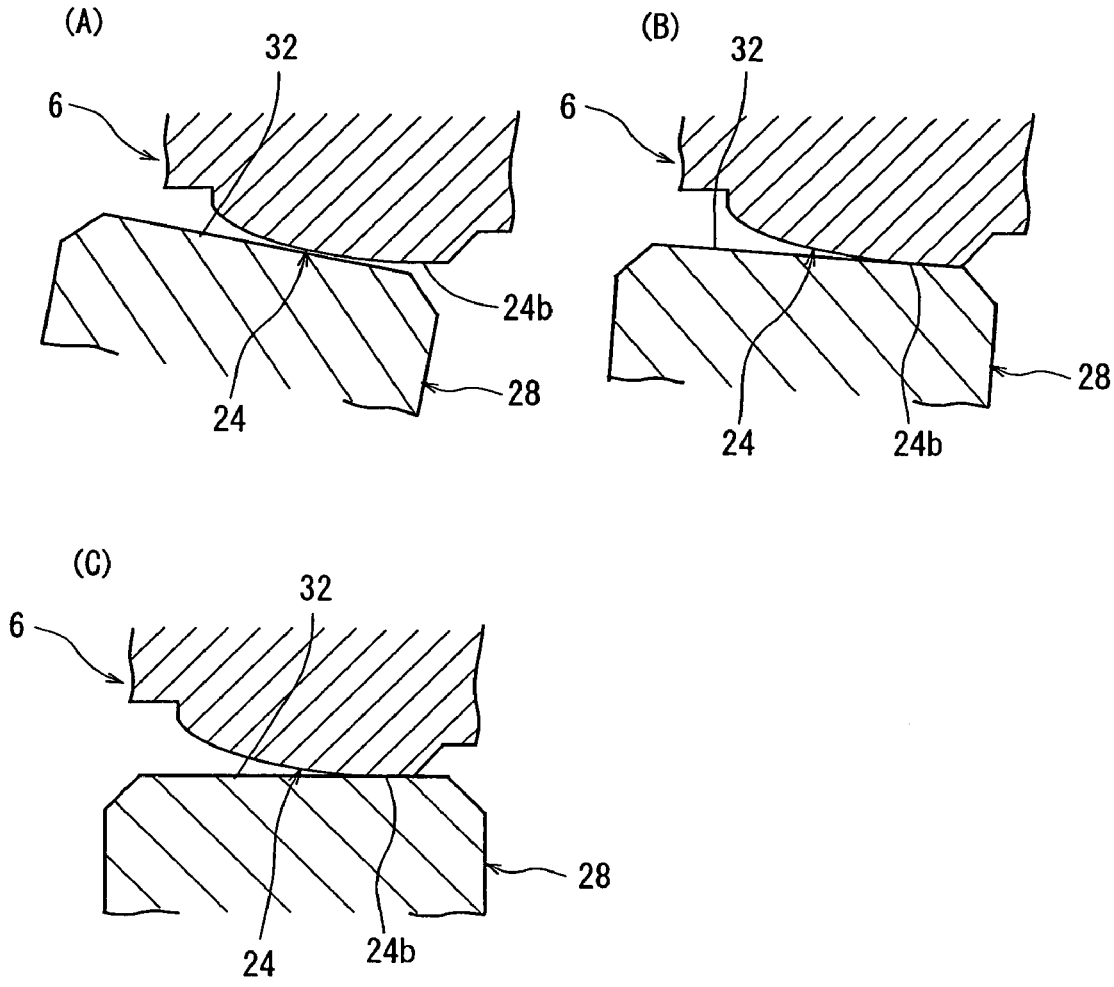
FIGS. 6(A) to 6(C) are enlarged sectional views showing FIGS. 5(A) to 5(C) in a partially enlarged manner.

There may be a case where the central axis of the mounting hole 32 is somewhat inclined with respect to the central axis of the mounting outer peripheral surface 24, as shown in FIG. 5A or FIG. 6A, when the mounting hole 32 of the tool support member 28 is fitted on the mounting outer peripheral surface 24 of the mounting member 6. Even in this case, according to the machining apparatus constructed in accordance with the present invention, the occurrence of drag is reliably avoided, when the length W1 in the central axial direction of the support region 24*b* of the mounting outer peripheral surface 24 is set at $\sqrt{D4^2-D1^2}$ or smaller ($W1 \leqq \sqrt{D4^2-D1^2}$). As shown in FIG. 5B and FIG. 6B and FIG. 5C and FIG. 6C, moreover, the rear surface of the tool support member 28 is brought into contact with the annular contact surface 22 of the mounting member 6, whereby the inclination of the tool support member 28 is corrected appropriately.

Figure 7:
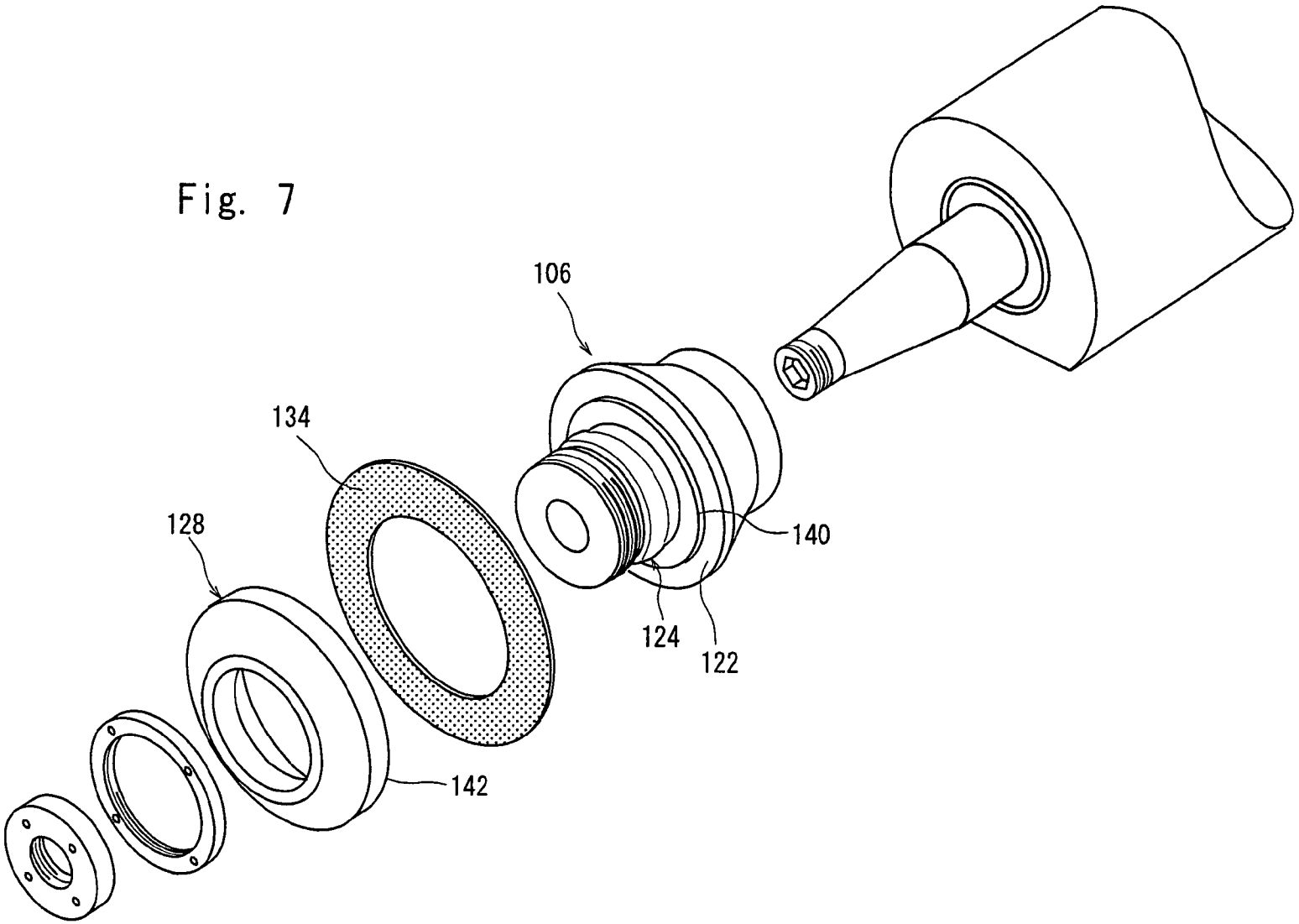
FIG. 7 is an exploded perspective view showing constituent elements concerned with mounting of a cutting blade in a modified embodiment of the machining apparatus constructed in accordance with the present invention.
Figure 8:
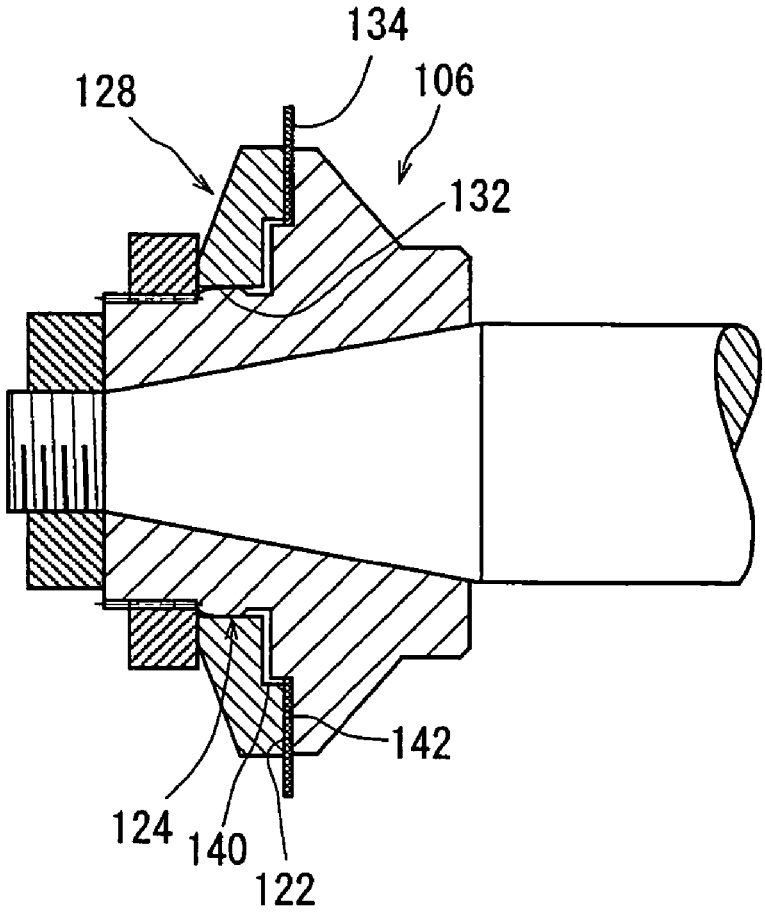
FIG. 8 is an assembly sectional view of the constituent elements shown in FIG. 7.

FIGS. 7 and 8 show a modified embodiment of the tool support member and the cutting blade. In the embodiment shown in FIGS. 7 and 8, a cylindrical mounting outer peripheral surface 140 located between an annular contact surface 122 and a mounting outer peripheral surface 124 is formed in a mounting member 106. A thin-walled annular cutting blade 134 is formed separately from a tool support member 128, and is mounted on the mounting outer peripheral surface 140 of the mounting member 106. In the tool support member 128, an annular protrusion 142 protruding rearwardly is formed in an outer peripheral edge portion of the rear surface of the tool support member 128. When the tool support member 128 is mounted, as required, on the mounting outer peripheral surface 124 of the mounting member 106, the annular protrusion 142 of the tool support member 128 is brought into contact with the front surface of the cutting blade 134, and the cutting blade 134 is sandwiched between the annular contact surface 122 of the mounting member 106 and the annular protrusion 142 of the tool support member 128, whereby the cutting blade 134 is firmly fixed in place. The inner diameter of a through-hole formed at the center of the cutting blade 134 is advantageously set to be greater, by a value of the order of 5 to 20 μm, particularly, 5 to 10 μm, than the outer diameter of the cylindrical mounting outer peripheral surface 140 of the mounting member 106. The inner diameter of the annular protrusion 142 of the tool support member 128 can be set to be somewhat larger than the outer diameter of the mounting outer peripheral surface 140 of the mounting member 106. Advantageously, the mounting outer peripheral surface 124 of the mounting member 106 and a mounting hole 132 of the tool support member 128 are substantially the same as the mounting outer peripheral surface 24 and the mounting hole 32 in the embodiment shown in FIGS. 1 to 3. Other features of the embodiment shown in FIGS. 7 and 8 may be substantially the same as those of the embodiment shown in FIGS. 1 to 3, and their descriptions are omitted to avoid duplication of the descriptions.

What I claim is:

1. A machining apparatus, comprising:

a mounting member to be rotationally driven;

a tool support member mounted on the mounting member; and a fixing member, fixed to the mounting member, for fixing the tool support member to the mounting member, the mounting member having a mounting outer peripheral surface of a generally cylindrical shape, a cylindrical mounting hole as a through-hole being formed in the tool support member, and the tool support member being mounted on the mounting member by fitting the mounting hole of the tool support member onto the mounting outer peripheral surface of the mounting member, and wherein the mounting outer peripheral surface of the mounting member has a guide region, a support region, and a relief region arranged sequentially in a central axial direction, the support region is of a cylindrical shape having an outer diameter D1, an outer diameter D2 of the guide region increases up to D1 toward the support region, an outer diameter D3 of the relief region decreases from D1 with increasing distance from the support region, the mounting hole of the tool support member has an inner diameter D4, D4 is larger than D1 (D4>D1), a length in the central axial direction of the support region of the mounting outer peripheral surface is W1, and W1 is $\sqrt{D4^2-D1^2}$ or smaller ($W1 \leqq \sqrt{D4^2-D^2}$).

2. The machining apparatus according to claim 1, wherein D4−D1 is 5 to 20 μm (5 μm≦D4−D1≦20 μm).

3. The machining apparatus according to claim 1, wherein a length in the central axial direction of the mounting hole is W2, and W2 is W1 or larger (W2>W1).

4. The machining apparatus according to claim 1, wherein a sectional shape in the central axial direction of the guide region of the mounting outer peripheral surface is an arc.

5. The machining apparatus according to claim 4, wherein a radius of curvature of the arc is D1/2 or smaller.

6. The machining apparatus according to claim 1, wherein the mounting member is detachably fixed to a rotating shaft mounted rotatably.

7. The machining apparatus according to claim 1, wherein a thin-walled annular cutting blade is fixed to the tool support member.

8. The machining apparatus according to claim 1, wherein a thin-walled annular cutting blade is sandwiched between the mounting member and the tool support member.

* * * * *